United States Patent [19]

Berry

[11] Patent Number: 5,044,669

[45] Date of Patent: Sep. 3, 1991

[54] STAMPABLE ADDRESSABLE SELF ADHESIVE LABEL

[76] Inventor: Richard M. Berry, 218 Grange Road, London SE1 3AA, England

[21] Appl. No.: 366,521

[22] Filed: Jun. 15, 1989

[30] Foreign Application Priority Data

Jun. 22, 1988 [GB] United Kingdom ..... 8814838

[51] Int. Cl.[5] ..... B42D 15/00

[52] U.S. Cl. ..... 283/81; 283/101; 40/360; 40/638; 229/74

[58] Field of Search ..... 283/81, 100, 101, 116, 283/61, 62; 40/638, 299, 360; 229/74

[56] References Cited

U.S. PATENT DOCUMENTS

| | | | |
|---|---|---|---|
| 1,204,502 | 11/1916 | Shuman | 229/74 X |
| 1,204,504 | 11/1916 | Shuman | 229/74 X |
| 1,497,702 | 6/1924 | Stanley | 229/74 |
| 3,655,121 | 4/1972 | Ward | 229/74 |
| 4,029,341 | 6/1977 | Neill et al. | 283/81 |
| 4,061,808 | 12/1977 | Sato | 40/299 |
| 4,519,631 | 5/1985 | Stone et al. | 283/81 |
| 4,614,361 | 9/1986 | Foster | 283/81 |
| 4,715,622 | 12/1987 | Mikhail | 283/81 |
| 4,725,077 | 2/1988 | Fujita | 283/81 |
| 4,872,705 | 10/1989 | Hartfeil | 283/81 |
| 4,872,706 | 10/1989 | Brewen et al. | 283/81 |

FOREIGN PATENT DOCUMENTS

| | | | |
|---|---|---|---|
| 2402264 | 4/1979 | France | 283/81 |
| 737892 | 10/1955 | United Kingdom | 40/638 |

*Primary Examiner*—Frank T. Yost
*Assistant Examiner*—Hwei-Siu Payer
*Attorney, Agent, or Firm*—Iandiorio & Dingman

[57] ABSTRACT

A stampable addressable self adhesive label comprising a first portion for receiving postage payment, a second portion for receiving an address and a backing sheet to which the first and the second portions are stuck, the first and the second portions having a pressure sensitive adhesive for enabling the first and the second portions to be peeled off the backing sheet and stuck on an item of mail, the first and the second portions being of a size that is permitted by regulations governing the sending of mail through the post, and the first and the second portions being such that they are able to be peeled off the backing sheet separately from one another whereby the first portion can be stuck on the item of mail in a postage payment position and the second portion can be stuck on the item of mail in an address position.

9 Claims, 2 Drawing Sheets

STAMPABLE ADDRESSABLE SELF ADHESIVE LABEL

This invention relates to a self adhesive label and, more especially, this invention relates to a stampable addressable self adhesive label.

Many businesses advertise their products or services such that the businesses state that they will provide further details on receipt from interested persons of a self addressed stamped envelope (SASE). Problems arise with the persons sending the stamped addressed envelope often providing an envelope that is of an incorrect size. Often businesses sending details of their products or their services require a relatively large envelope and such envelopes are often not normally possessed by individuals and it may be necessary for such individuals to make a separate trip to a Post Office or a stationery shop for the purpose of purchasing an envelope of the required size. Furthermore, with advancing technology, many businesses are able automatically to pack products or details of products or services using automated packaging machines. Such businesses may find that time is wasted in taking a stamped addressed envelope from a person making an enquiry or a purchase and then filling that envelope with the appropriate products or information. Also, in the United Kingdom and some other countries, payment of small amounts by mail can be made with loose postage stamps, which can easily be lost.

It is an aim of the present invention to reduce the above mentioned problems.

Accordingly, in one embodiment of the present invention there is provided a stampable addressable self adhesive label comprising a first portion for receiving postage payment means, a second portion for receiving an address, a third portion for receiving postal code indicator means for indicating a postal code, a backing sheet to which the first, second and third portions are stuck, and a low tack adhesive strip on the back of the backing sheet, the first, second and third portions having a pressure sensitive adhesive for enabling the first, second and third portions to be peeled off the backing sheet and stuck on an item of mail, the first, second and third portions each being of a size that is permitted by regulations governing sending of mail through post, the second portion being larger than the third portion, and the first, second and third portions being such that they are able to be peeled off the backing sheet separately from one another whereby the first portion can be stuck on the item of mail in a postage payment position, the second portion can be stuck on the item of mail in an address position, and the third portion can be stuck on the item of mail in a postcode position.

In another embodiment of the invention, there is provided a stampable addressable self adhesive label comprising a first portion bearing postage payment means, a second portion bearing an address, a third portion bearing postal code indicator means for indicating a postcode, and a backing sheet to which the first, second and third portions are stuck, the first, second and third portions having a pressure sensitive adhesive for enabling the first, second and third portions to be peeled off the backing sheet and stuck on an item of mail, the first, second and third portions each being rectangular in plan and of a size that is permitted by regulations governing sending of mail through post, the first, second and third portions being of the same length, the second portion being wider than the third portion, the first, second and third portions being such that they are able to be peeled off the backing sheet separately from one another whereby the first portion can be stuck on the item of mail in a postage payment position, the second portion can be stuck on the item of mail in an address position, and the third portion can be stuck on the item of mail in a postcode position, and the stampable addressable self adhesive label being such that it has top and bottom edges which are 100 mm (4 inches) long and side edges which are 105 mm ($4\frac{1}{4}$ inches) long.

In a further embodiment of the invention, there is provided a stampable addressable self adhesive label comprising a first portion bearing postage payment means, a second portion bearing an address, a third portion bearing postal code indicator means for indicating a postal code, and a backing sheet to which the first, second and third portions are stuck, the first, second and third portions having a pressure sensitive adhesive for enabling the first, second and third portions to be peeled off the backing sheet and stuck on an item of mail, the first, second and third portions each being of a size that is permitted by regulations governing sending of mail through post, the second portion being larger than the third portion, and the first, second and third portions being such that they are able to be peeled off the backing sheet separately from one another whereby the first portion can be stuck on the item of mail in a postage payment position, the second portion can be stuck on the item of mail in an address position, and the third portion can be stuck on the item of mail in a postcode position.

Because the label of the present invention is a self adhesive label, it will be apparent that the first and the second portions can easily be stuck on to envelopes of a required size so that the above mentioned problem of providing envelopes of the correct size can be avoided. Furthermore, the first and the second portions of the label of the present invention can be additionally used for items of mail other than envelopes such for example as postcards and parcels.

Preferably, the pressure sensitive adhesive is one which has a low temperature freezing point. The pressure sensitive adhesive will then not tend to freeze in especially cold conditions. Whilst such cold conditions are rarely experienced in the United Kingdom, they are experienced in countries having cold winters such for example as Canada and Russia. In such countries having cold winters, if the pressure sensitive adhesive freezes at a relatively high temperature, then difficulty may be encountered in removing the first and the second portions from the backing sheet. Preferably, the pressure sensitive adhesive is also such that it does not melt when exposed to high temperatures, for example from the hot sun.

The first and the second portions may be formed from a single sheet member which is stuck on the backing sheet and which is then cut to define the first and the second portions.

The single sheet member may be cut with a single cut which goes completely through the sheet member. The single sheet member may alternatively be cut with a single cut that goes nearly through the sheet member but not completely through the sheet member. Such a cut may be known as a kiss cut and it may be effected with a skimming knife or skimming knives.

If desired, the single sheet member may be cut so that it is provided with a line of perforations. Still further, the single sheet member may be cut such that a narrow strip of the single sheet member is removed. Similarly, the single sheet member may be provided with any type of cut that is suitable and appropriate and the cut may be effected with a knife blade, a rotary cutting wheel or other means.

As indicated above, the first portion of the label is for receiving the postage payment means. The postage payment means may be one or more stamps, franking markings from a franking machine, postage paid impressions, an adhesive postage paid strip, or any other suitable means. With one or more stamps, the stamps will be stuck to the first portion and then the first portion can be stuck to the item of mail to be posted.

The first portion of the label is also such that it is preferably able to receive postmark cancellation means of the type normally employed by postal authorities.

As mentioned above, the second portion is able to receive the address. The second portion should thus be of a size to conveniently receive the address, whether the address is typed, written by hand or otherwise provided on the second portion.

During use of the label, it is then only necessary for a recipient of the label to remove the first and the second portions and to stick them in appropriate positions on a required item of mail.

The label has a third portion for receiving first indicator means for indicating a postal code.

The label may also include a fourth portion for receiving second indicator means for indicating a recipient's customer reference number and date received.

The first and the second indicator means may be in the form of dots or bars and the dot codes or the bar codes may be read optoelectronically, magnetically or horologically. Such dot codes and bar codes are already used by postal authorities in various countries. For example, the United Kingdom uses dot codes and the U.S.A. uses bar codes. The first and/or the second indicator means can be transferred to the label by a special personalised pre-inked microporous plastics stamping device.

A sender of the label of the present invention may be provided with means for applying the first and/or the second indicator means on to the label. Thus the sender of the label would be able to ensure that once the label was used on an item of mail, the item of mail would be sent back as soon as possible since all requirements to help the delivery of the item of mail would have been complied with.

The label of the present invention may be made in various sizes. Thus, for example, the label may be made in different sizes to suit different items of mail. The sizes required by the regulations governing the sending of mail may differ from country to country. Generally, the label will be required to comply with the regulations in force for envelopes. The label will then generally be able to be used on other items of mail such for example as cards and packages.

In the United Kingdom, the label should be such as to comply with the Post Office requirements for preferred sizes of envelopes to enable easy handling of the envelopes by the Post Office sorting equipment. Thus the label should be such that it will fit on envelopes that are not smaller than 90×140 mm (3.5×3.5 ins) and that are no larger than 120×235 mm (4.75×9.25 ins). The envelopes will normally oblong in shape with the longer side being at least 1.41 four times the shorter side.

The envelopes may be made of paper and where they are made of paper, they should preferably weight at least 63 grammes per square meter. The envelopes may also be made of a plastic material. The plastics material may be transparent or opaque. The plastics material is preferably white but it may be of a pastel shade. Where plastic envelopes are employed, they should be provided with opaque areas able to receive the first and the second portions of the stampable addressable self adhesive label. A presently preferred plastics material is polythene.

The envelopes to receive the label of the present invention will not usually have a window in them but, if desired, they may have a window for showing advertising material.

If desired, the label of the present invention may be provided with a fifth portion for providing space for advertising. The advertising space may be for advertising the products or services of the sender, for advertising the services of the postal authority, or for advertising the products or services of private companies and individuals.

As mentioned above, if the stampable addressable self adhesive label is used outside the United Kingdom, then other postal regulations may apply. The label may then be produced to a size or sizes to conform to the Universal Postal Convention or U.S.A. postal regulations.

The backing sheet may be of any suitable and appropriate type of material. Thus the backing sheet may be of the type of material that is currently used by the United Kingdom postal authorities for special delivery labels, recorded delivery labels or air mail sticker labels.

The backing sheet may be made of craft paper.

The backing sheet may be provided with a release agent to ensure that the first and the second portions and any other portions employed, may easily be removed from the backing sheet. The release agent may be a silicone release agent.

The pressure sensitive adhesive may be a high tack adhesive. A low tack adhesive strip may be employed on the back of the backing sheet. Many businesses sending back items of mail using the label of the present invention may wish to keep a note of the name and address of the persons to whom they are sending. This then enables the businesses to send follow up literature or whatever else may be desired. With a suitable adhesive such as a low tack adhesive, the label can stuck on grid means which can then be photocopied as may be desired. A plurality of the second portions can be photocopied or photographed together to provide the businesses with easy references of the names and addresses of persons to whom they have sent mail. After the addresses have been copied, the second portions can be then be stuck on the items of mail as mentioned above.

The label of the present invention may be sold in the form of a single label. Alternatively, it may be sold in the form of a book of the labels or a packet of the labels. Where a book or a packet of the labels is involved, the book or the packet may include stamps if desired. For example, with a book of labels, the first sheet of the book could be a sheet of stamps for use with the labels. The book or the packet of the labels may contain as many of the labels as desired, for example 10, 20 or 30 of the labels.

With a shared backing sheet, there may be two or more of the labels on a single sheet member, with the first and the second portions all being stuck on the shared backing sheet.

The label of the present invention, irrespective of how it is made, for example as a single label, a book of labels, a packet of labels, a large sheet member or a roll, can be dispensed from machines if desired. Thus, a dispensing machine could be arranged to dispense the appropriate form of the label of the present invention on receipt of appropriate coins, tokens, horological cards or magnetic cards. The machine may be programmed to dispense whatever is required and appropriate once appropriate control members have been pressed or dialled.

The label of the present invention will usually be such that the first portion is provided on top of the second portion. Such an arrangement will usually give rectangular first and second portions with the first and the second portions usually being of the same length but with the second portion being wider than the first portion. The second portion will usually be wider than the first portion because the second portion will need to have the address of the sender which will occupy more space than the postage payment means on the first portion. If desired, the first and the second portions can be of different lengths and they can be of equal widths.

If desired, the first and the second portions can be arranged side by side. This may be preferred in countries which read from top to bottom as opposed to side by side as in the United Kingdom.

Embodiments of the invention will now be described solely by way of example and with reference to the accompanying drawings in which.

Figure 1:
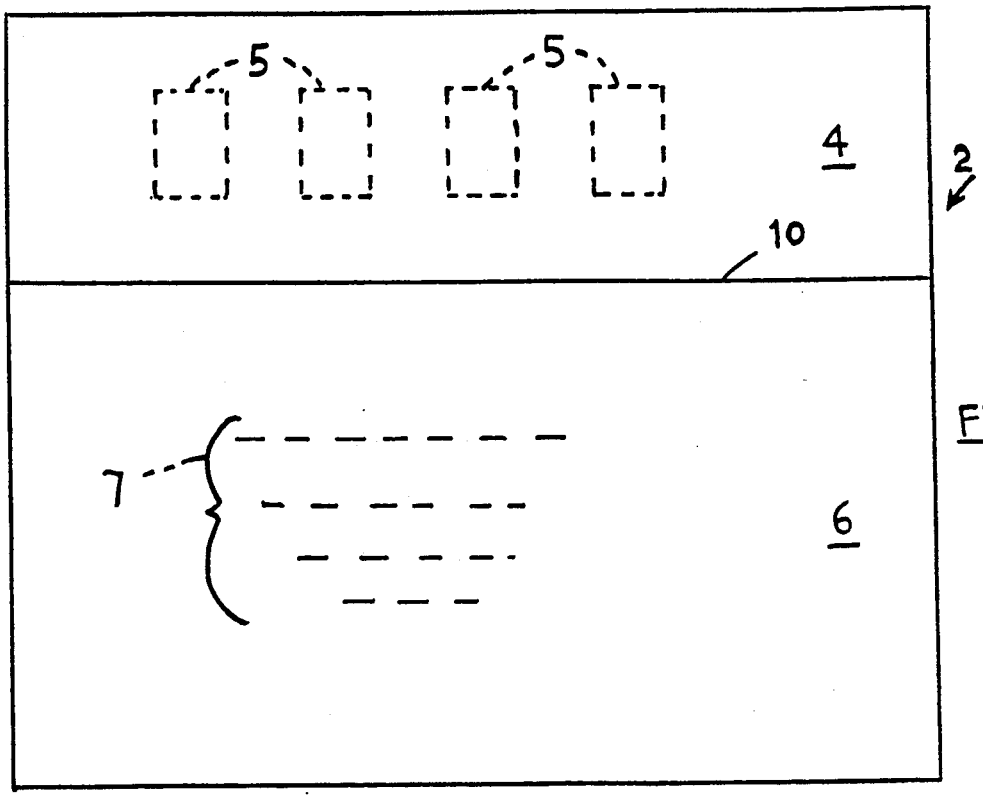
FIG. 1 shows a first stampable addressable self adhesive label.
Figure 2:
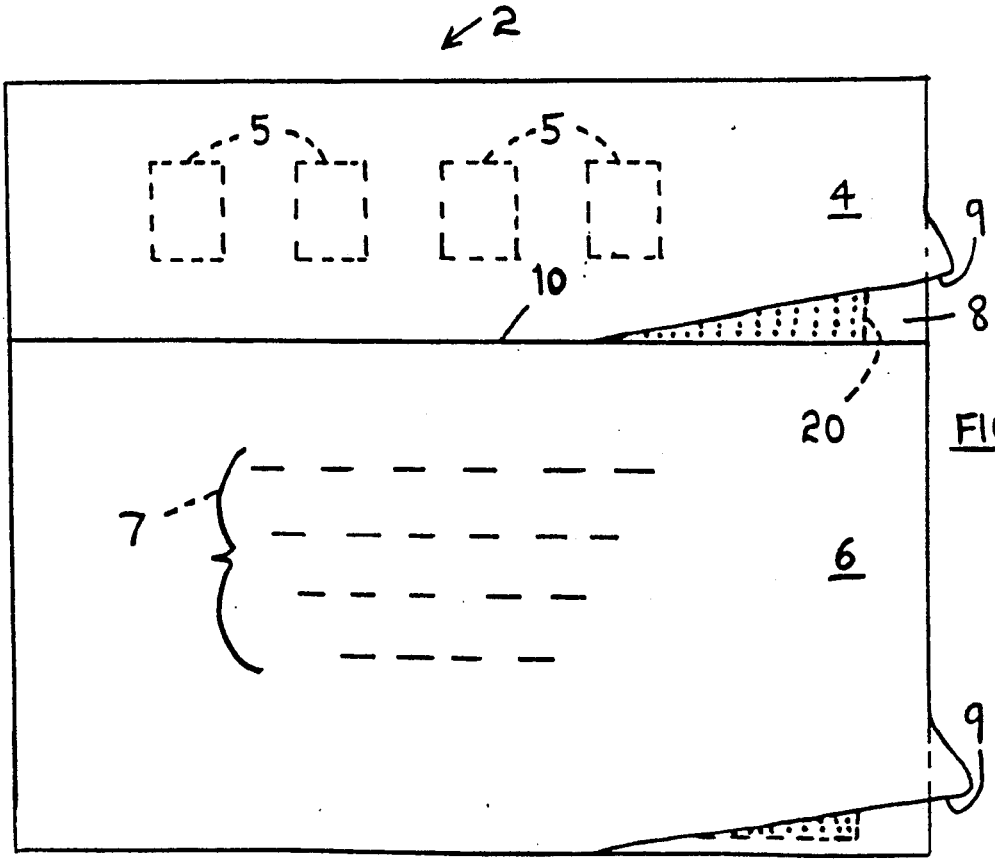
FIG. 2 shows first and second portions of the label shown in FIG. 1 being removed from a backing sheet.

Referring to FIGS. 1 and 2, there is shown a stampable addressable self adhesive label 2 comprising a first portion 4 for receiving postage payment means in the form of stamps 5, and a second portion 6 for receiving an address 7. The first and the second portions 4, 6 are stuck to a backing sheet 8 by means of a pressure sensitive adhesive 9 applied over the surfaces of the first and the second portions 4, 6 which are adjacent the backing sheet 8. The backing sheet 8 is made of waxed craft paper which is thus easily able to enable the first and the second portions 4, 6 to be peeled off the backing sheet 8 and stuck on an item of mail.

The label 2 is of such a size that the first and the second portions 4, 6 are of a size that is permitted by regulations governing the sending of mail through the post. The label 2 can be sent by a person for use by a recipient in sending back to the person required items of mail. All the recipient has to do is to place the appropriate goods or literature in an appropriate envelope and then to peel off the first portion 4 and place it on the appropriate part of the envelope where postage payment means such for example as stamps or postal franking marks are positioned. The second portion 6 is also peeled off the backing sheet 8 and placed on the part of the envelope at the place where addresses are given. The entire operation can thus be very simply, swiftly and conveniently effected.

FIG. 2 shows how the first and the second portions 4, 6 are able to be peeled off the backing sheet 8 separately from each other. This is because the first and the second portions 4, 6 were initially formed as a single sheet member which was stuck on the backing sheet 8 and which was then cut to define the first and the second portions. The single sheet member was cut with a single line cut 10 which extended completely through the sheet member to thus completely separate the first and the second portions 4, 6.

Figure 3:
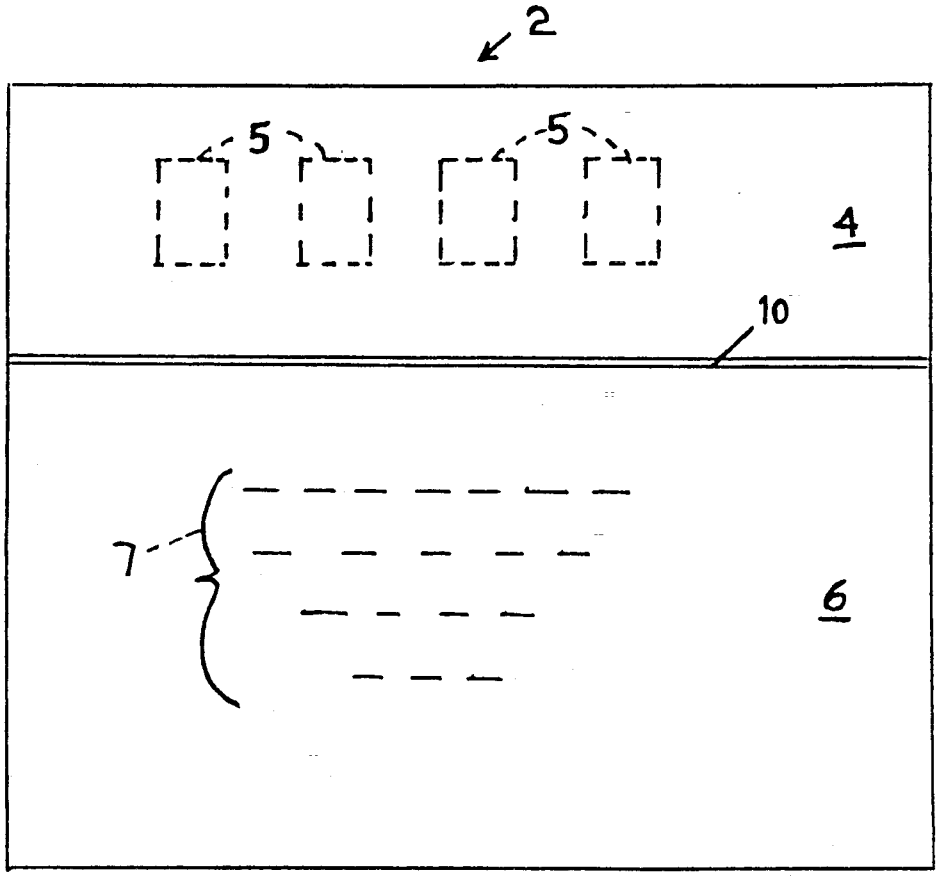
FIG. 3 shows a second stampable addressable self adhesive label.

Referring now to FIG. 3, there is shown a second stampable addressable self adhesive label 2. In FIG. 3, similar parts as in FIG. 1 have been given the same reference numerals for ease of comparison and understanding. In FIG. 3, it will be seen that the single line cut 10 is wider than the single line cut 10 shown in FIGS. 1 and 2. In FIG. 3, the single line cut 10 has been effective to remove a narrow strip of the single sheet member that was used to form the first portion 4 and the second portion 6.

Figure 4:
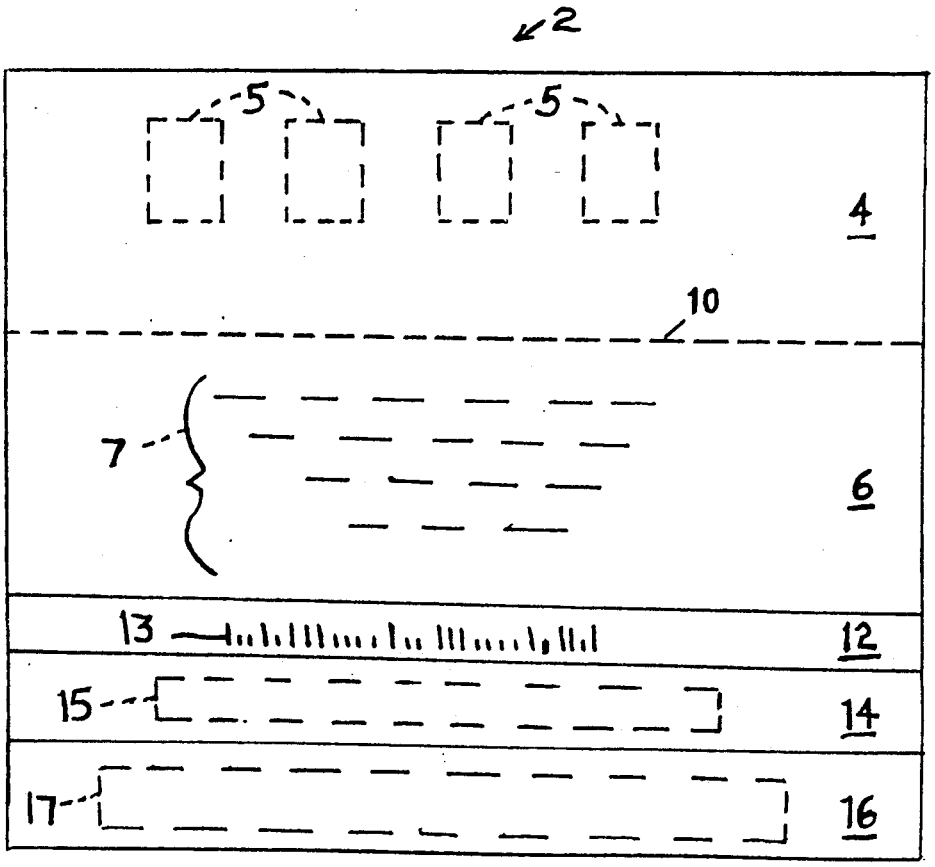
FIG. 4 shows a third stampable addressable self adhesive label.

FIG. 4 shows a third stampable addressable self adhesive label in which similar parts as in FIGS. 1 and 2 have again been given the same reference numerals for ease of comparison and understanding. In FIG. 4, the single line cut 10 is in the form of a dotted line which provides a line of weakness. In FIG. 4, the first and the second portions 4, 6 need to be torn along the line of weakness formed by the single line cut 10 before they can be removed from the backing sheet 8.

It is to be appreciated that the embodiments of the invention described above with reference to the accompanying drawings have been given by way of example only and that modifications may be effected. Thus, for example, the labels 2 may be used on items of mail other than envelopes so that they may be used on items of mail such for example as postcards, packets and parcels. Also, the first and the second portions 4, 6 may be separated from each other by cuts other than the illustrated single line cuts 10. Further, the labels 2 can be of different shapes than illustrated and the second portion 6 can be placed on top of the first portion 4 or, alternatively, the first and the second portions 4, 6 can be placed side by side as opposed to on top of one another. The first and the second portions will usually be made from paper but they may be made from other materials if desired. The labels 2 may be made in various desired sizes so that, for example, the labels 2 as shown in the drawings may have top and bottom edges which are 100 mm long and side edges which are 105 mm long. Also, as shown in FIG. 4, the labels 2 may be provided with a third portion 12 for receiving indicator means 13 for indicating a postal code and/or a fourth portion 14 for indicating a recipient's customer reference 15 and date received and/or a fifth portion 16 for providing space for advertising 17.

If desired, the labels of the invention may be provided with a postage stamp or the like which is acceptable throughout the European Economic Community. Also, if desired, the labels of the invention may be provided with a free stamp of a predetermined value for encouraging persons to post a reply. As shown in FIG. 2, if desired, a low tack adhesive 20 may be provided on the back of the backing sheet 8.

I claim:

1. A stampable addressable self adhesive label comprising a first portion bearing postage payment means, a second portion bearing an address, a third portion bearing postal code indicator means for indicating a postal code, and a backing sheet to which the first, second and third portions are stuck, the first, second and third portions having a pressure sensitive adhesive for enabling the first, second and third portions to be peeled off the backing sheet and stuck on an item of mail, the first, second and third portions being of the same length, the second portion being wider than the third portion, the first, second and third portions being such that they are able to be peeled off the backing sheet separately from one another whereby the first portion can be stuck on the item of mail in a postage payment position, the second portion can be stuck on the item of mail in an address position, and the third portion can be stuck on the item of mail in a postcode position, and the stampable addressable self adhesive label being such that it has top and bottom edges which are 100 mm (4 inches) long and side edges which are 105 mm ($4\frac{1}{4}$ inches) long.

2. A stampable addressable self adhesive label according to claim 1 in which the first and the second portions are formed from a single sheet member which is stuck on the backing sheet and which is then cut to define the first and the second portions.

3. A stampable addressable self adhesive label according to claim 1 in which the backing sheet is provided with a release agent, and in which the pressure sensitive adhesive is a high tack adhesive.

4. A stampable addressable self adhesive label according to claim 1 and including a fourth portion for receiving reference indicator means such as a recipient's customer reference and date received.

5. A stampable addressable self adhesive lael according to claim 4 and including a fifth portion having space for advertising.

6. A stampable addressable self adhesive label comprising a first portion for receiving postage payment means, a second portion for receiving an address, a third portion for receiving postal code indicator means to indicate a postal code, a backing sheet to which the first, second and third portions are stuck, and a low tack adhesive strip on the back of the backing sheet, the first, second and third portions having a pressure sensitive adhesive for enabling the first, second and third portions to be peeled off the backing sheet and stuck on an item of mail, the second portion being larger than the third portion, and the first, second and third portions being such that they are able to be peeled off the backing sheet separately from one another whereby the first portion can be stuck on the item of mail in a postage payment position, the second portion can be stuck on the item of mail in an address position, and the third portion can be stuck on the item of mail in a postcode position.

7. A stampable addressable self adhesive label according to claim 6 and including a fourth portion for receiving reference indicator means such as a recipient's customer reference and date received.

8. A stampable addressable self adhesive label according to claim 7 and including a fifth portion having space for advertising.

9. A stampable addressable self adhesive label comprising a first portion bearing postage payment means, a second portion bearing an address, a third portion bearing postal code indicator means for indicating a postal code, and a backing sheet to which the first, second and third portions are stuck, the first, second and third portions having a pressure sensitive adhesive for enabling the first, second and third portions to be peeled off the backing sheet and stuck on an item of mail, the second portion being larger than the third portion, and the first, second and third portions being such that they are able to be peeled off the backing sheet separately from one another whereby the first portion can be stuck on the item of mail in a postage payment position, the second portion can be stuck on the item of mail in an address position, and the third portion can be stuck on the item of mail in a postcode position.

* * * * *